US007923623B1

(12) United States Patent
Beaty

(10) Patent No.: US 7,923,623 B1
(45) Date of Patent: Apr. 12, 2011

(54) ELECTRIC INSTRUMENT MUSIC CONTROL DEVICE WITH MULTI-AXIS POSITION SENSORS

(76) Inventor: David Beaty, Mesa, AZ (US)

( * ) Notice: Subject to any disclaimer, the term of this patent is extended or adjusted under 35 U.S.C. 154(b) by 274 days.

(21) Appl. No.: 12/253,852

(22) Filed: Oct. 17, 2008

Related U.S. Application Data

(60) Provisional application No. 60/980,721, filed on Oct. 17, 2007.

(51) Int. Cl.
*G10H 1/02* (2006.01)

(52) U.S. Cl. ..... 84/701

(58) Field of Classification Search ..... 84/701, 84/735

See application file for complete search history.

(56) References Cited

U.S. PATENT DOCUMENTS

| | | | |
|---|---|---|---|
| 4,932,261 | A | 6/1990 | Henrion |
| 5,345,824 | A | 9/1994 | Sherman et al. |
| 5,392,650 | A | 2/1995 | O'Brien et al. |
| 5,540,095 | A | 7/1996 | Sherman et al. |
| 5,635,739 | A | 6/1997 | Grieff et al. |
| 5,835,077 | A | 11/1998 | Dao et al. |
| 5,962,784 | A | 10/1999 | Hulsing, II |
| 5,974,879 | A | 11/1999 | Hulsing, II |
| 5,992,233 | A | 11/1999 | Clark |
| 6,295,870 | B1 | 10/2001 | Hulsing, II |
| 6,463,802 | B2 | 10/2002 | Hulsing, II |
| 6,474,160 | B1 | 11/2002 | Stewart et al. |
| 6,516,283 | B2 | 2/2003 | McCall et al. |
| 6,522,992 | B1 | 2/2003 | McCall et al. |
| 6,557,415 | B2 | 5/2003 | Stewart et al. |
| 6,701,788 | B2 | 3/2004 | Babala |
| 6,703,939 | B2 | 3/2004 | Lehrman et al. |
| 6,713,829 | B1 | 3/2004 | Karpman |
| 6,725,719 | B2 | 4/2004 | Cardarelli |
| 6,765,489 | B1 | 7/2004 | Ketelhohn |
| 6,843,126 | B2 | 1/2005 | Hulsing, II |
| 6,848,304 | B2 | 2/2005 | Geen |
| 6,868,726 | B2 | 3/2005 | Lemkin et al. |
| 6,925,876 | B2 | 8/2005 | Babala |
| 7,069,785 | B2 | 7/2006 | Chou |
| 7,095,331 | B2 | 8/2006 | Lehrman et al. |
| 7,194,376 | B2 | 3/2007 | Zarabadi |
| 7,243,542 | B2 | 7/2007 | Hulsing, II |
| 2001/0045128 | A1 | 11/2001 | McCall et al. |
| 2006/0169041 | A1 | 8/2006 | Madni et al. |
| 2006/0272413 | A1 | 12/2006 | Vaganov et al. |
| 2007/0135739 | A1 | 6/2007 | Halperin et al. |
| 2007/0146323 | A1 * | 6/2007 | Nishikata et al. ..... 345/158 |

* cited by examiner

*Primary Examiner* — Jianchun Qin
(74) *Attorney, Agent, or Firm* — Schmeiser, Olsen & Watts LLC

(57) ABSTRACT

An electric instrument music control device is provided having at least two multi-axis position sensors. One sensor is a reference multi-axis position sensor retained in a fixed position the reference multi-axis position sensor having at least one axis held in a fixed position. Another sensor is a moveable multi-axis position sensor rotatable about at least one axis corresponding to the at least one axis of the reference multi-axis position sensor, wherein the moveable multi-axis position sensor is in communication with the reference multi-axis position sensor. The device may include a processor that processes the differentiation between the angular position of the at least one axis of the reference multi-axis position sensor and the at least one axis of the moveable multi-axis position sensor, wherein the angular differentiation correlates to a music effect of an electric instrument.

14 Claims, 3 Drawing Sheets

ELECTRIC INSTRUMENT MUSIC CONTROL DEVICE WITH MULTI-AXIS POSITION SENSORS

CROSS REFERENCE TO RELATED APPLICATION

This application claims priority to U.S. Provisional Patent Application to entitled "ELECTRIC INSTRUMENT MUSIC CONTROL DEVICE WITH MULTI-AXIS POSITION SENSORS," Ser. No. 60/980,721, filed Oct. 17, 2007, the disclosure of which is hereby incorporated entirely herein by reference.

BACKGROUND OF THE INVENTION

1. Technical Field

This invention relates generally to an electric instrument music control device and more particularly to an electric instrument music control device that utilizes multi-axis position sensors to control various music effects.

2. State of the Art

The use of a pedal to control effects of an electric instrument is often employed by a musician to control effects such as volume, vibrato, tone or other types of music effects of an electric instrument. Conventionally, the method in which musicians control these effects is by use of an effects pedal. A conventional effects pedal is an electronic effects unit typically housed in a chassis used by musicians to modify the sound of their instrument.

These conventional effects pedals sit on the floor and have large on/off switches on top that are activated using the foot. Some pedals, such as volume pedals, employ what is known as an expression pedal, which is manipulated while in operation by rocking a large foot-activated pedal mechanically coupled to a potentiometer in a single back and forth motion. The relative position of the expression pedal thus determines the extent to which the music effect is altered. These effects pedals permit the musician to activate and deactivate effects and/or vary the intensity of effects while playing an electric instrument.

Other conventional effects pedals include pedals that utilize light, wherein the pedal controls the amount of light that is directed to a photo cell or other light level sensing devices, the amount of light corresponding to a change in a music effect or characteristic. Further still, other conventional effects pedals include the use of a micro-controller with a bar code that is changed to effect change in the music characteristic of the instrument.

While these conventional devices control music effects of electric instruments, they have their limitations. For example, conventional effects pedals typically require the musician to use a single pedal or input device to control a single music effect, which means that in order to control volume, vibrato and tone the musician would use multiple pedals. Further, conventional pedals are subject to wear due the mechanical operation of the potentiometer or the limited life of a light source. Conventional pedals are also limited in their ability to adjust the music effect according to various effects curves and/or at a preferred effect curve of the particular musician. Additionally, the musician needs to dedicate one foot during a performance in order to control these effects during playing of the electric instrument, thereby preventing the use of one foot that may otherwise be used for another purpose such as to generate notes with another particular electric instrument. Further still, the conventional devices are static and placed in a single location on a fixed surface.

Accordingly, there is a need in the field of electric instruments music effects devices for an improved electric music effects device that overcomes the limitations of conventional electric music effects devices.

DISCLOSURE OF THE INVENTION

The present invention relates to an electric instrument music control device comprising at least two multi-axis position sensors, wherein the music control device may control multiple separate music characteristics with a single input device. Each music characteristic is controllable by the rotation about one axis of a multi-axis position sensor.

An aspect of the present invention may include an electric instrument music control device comprising a reference multi-axis position sensor retained in a fixed position and a moveable multi-axis position sensor rotatable about at least one axis, wherein the moveable multi-axis position sensor is in communication with the reference multi-axis position sensor. The music control device may further include a processor that processes the differentiation between the angular position of the reference and moveable position sensors about the at least one axis, wherein the angular differentiation about the axis correlates to a music effect or setting of an electric instrument.

In particular embodiments, the at least one axis may include at least two axes or further still at least three axes about which the moveable multi-axis position sensor may rotate about.

Another aspect of the present invention may include a method of using an electric instrument music control device, the method comprising retaining a reference multi-axis position sensor in a fixed position, rotating a moveable multi-axis position sensor about at least one axis, and controlling a music effect by rotating the moveable position sensor.

The foregoing and other features and advantages of the present invention will be apparent from the following more detailed description of the particular embodiments of the invention.

BRIEF DESCRIPTION OF THE DRAWINGS

The invention will hereinafter be described in conjunction with the appended drawings where like designations denote like elements, and.

DETAILED DESCRIPTION OF EMBODIMENTS OF THE INVENTION

As discussed above, embodiments of the present invention relate to an electric instrument music control device comprising at least two multi-axis position sensors, wherein the music control device may control multiple separate music characteristics with a single input device. Each music characteristic or music effect is controllable by the rotation about one axis of a multi-axis position sensor.

Figure 1:
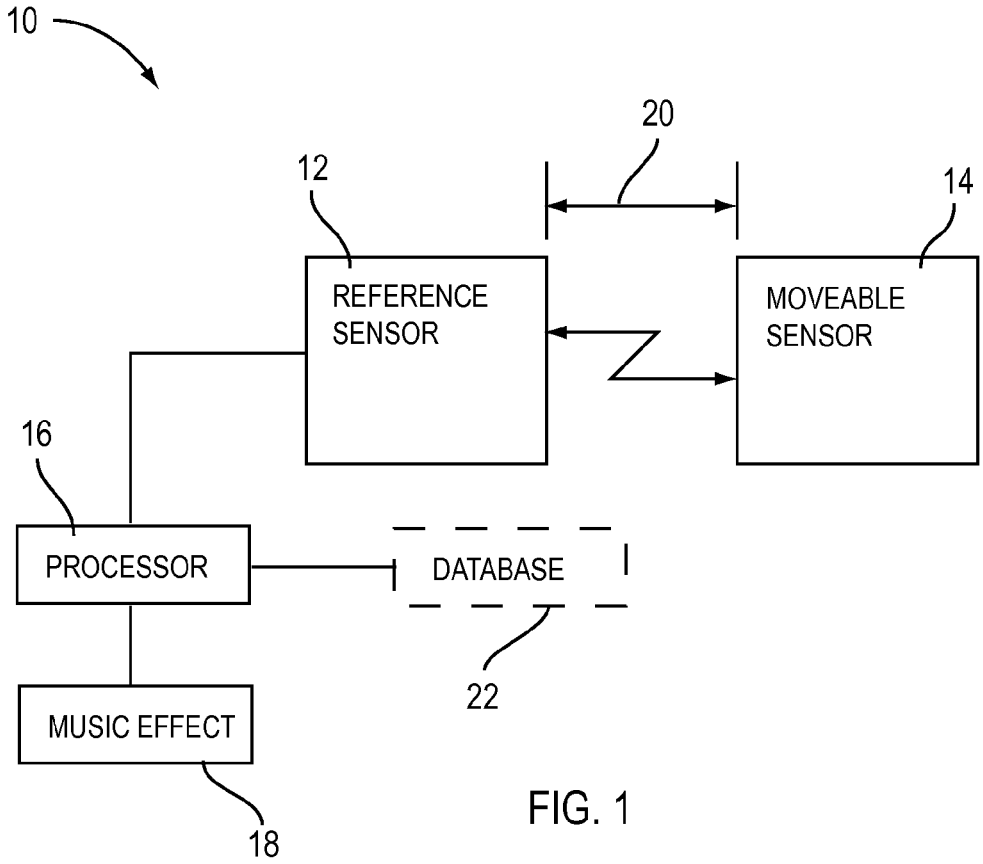
FIG. 1 is a schematic view of a music control device in accordance with the present invention.

Referring to FIG. 1 and according to particular embodiments of the present invention, a electric instrument music control device 10 may include at least two multi-axis position sensors, a reference multi-axis position sensor 12 and a moveable multi-axis position sensor 14. Each multi-axis position sensor 12 and 14 may be a sensor that is used to measure acceleration. Each sensor 12 and 14 includes signal conditioned voltage outputs, which are all on a single monolithic integrated circuit ("IC"). Each sensor 12 and 14 may measure acceleration with a predetermined reliability factor. Each sensor 12 and 14 may also measure both dynamic acceleration (vibration) and static acceleration (gravity).

Each multi-axis position sensor 12 and 14 may include a polysilicon surface micromachined sensor and signal conditioning circuitry to implement an open loop acceleration measurement architecture. Each multi-axis position sensor 12 and 14 senses angles and acceleration in any direction. The output signals are analog voltages that are proportional to acceleration. Each multi-axis position sensor 12 and 14 may also be used as a tilt sensor, wherein the accelerometer measures static acceleration forces, such as gravity, which allows it to be used as a tilt sensor. When each multi-axis position sensor 12 and 14 is oriented so both its X-axis and Y-axis are parallel to the earth's surface, it can be used as a two-axis tilt sensor with both a roll axis and a pitch axis.

Figure 2:
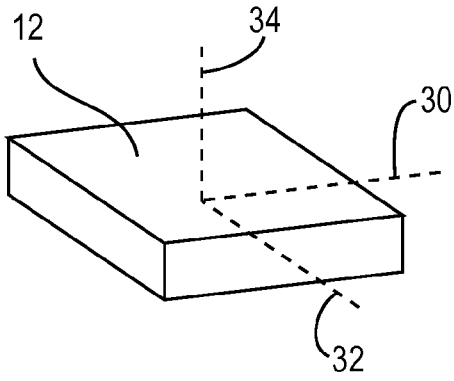
FIG. 2 is perspective schematic view of a reference multi-axis position sensor.
Figure 3:
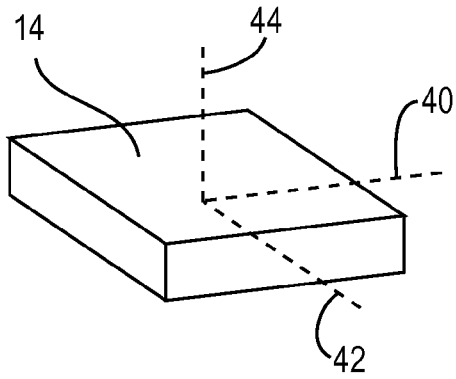
FIG. 3 is a perspective schematic view of a moveable multi-axis position sensor.

With additional reference to FIGS. 2 and 3, embodiments of the present invention include an electric instrument music control device 10 that comprises at least two multi-axis position sensors 12 and 14. A reference multi-axis position sensor 12 may be retained in a fixed position. Retaining the reference multi-axis position sensor 12 in a fixed position includes retaining it such that the angle of the reference sensor 12 is static relative to the X-axis 30, Y-axis 32 and Z-axis 34. The reference sensor 12 held in a fixed position may be a reference position of the music control device 10. A moveable multi-axis sensor 14 may be rotatable about at least one axis. The rotation about the at least one axis of the moveable sensor 14 controls an effect of the electric instrument. The at least one axis may any one of the X-axis 40, the Y-axis 42 and the Z-axis 44. The moveable sensor 14 may be in communication with the reference sensor 12 such that they may be comparable. The reference and the moveable sensors 12 and 14 need not be in close proximity to each other, but rather are attitude dependent, meaning that the angular position about a particular axis with respect to each other determines the operation of the music control device 10. Accordingly, the reference sensor 12 and the moveable sensor 14 may be widely separated a distance 20 so long as they can communicate with each other. The distance 20 between the reference sensor 12 and the moveable sensor 14 may be a dynamic distance 20 that changes in response to movement of a musician with the moveable sensor 14 coupled to the musician toward and away from the reference sensor 12.

The music control device 10 may further comprise a processor 16. The processor 16 may be used to compare the angle of the moveable sensor 14 about at least one of the X-axis 40, the Y-axis 42 and the Z-axis 44 relative to the angle of the reference sensor 12 about the same axis. The measured differentiation of the angles of the reference and moveable sensors 12 and 14 about the at least one axis correlates to a certain change in music effect 18. For example and without limitation, the music effect 18 may be the volume of the electric instrument. As the moveable sensor 14 is rotated about the at least one axis, the change in the differentiation of the angle of the moveable sensor 14 relative to the angle of the reference sensor 12 establishes a change in the volume of the electric instrument. Maintaining the moveable sensor 14 in a fixed position once a desired music characteristic or effect is reached will maintain that music characteristic constant.

Other embodiments of the present invention may include three or more multi-axis position sensors, with a reference sensor 12 being one the multi-axis position sensors. The reference sensor 12 may be held in a fixed position and every other sensor may be a moveable sensor 14 that may be rotatable about at least one axis. Each moveable sensor 14 may then be used to control up to three music effects. Other embodiments may include rotation about a plurality of axes by a single sensor, wherein the sensor then controls a plurality of music effects of an electric instrument.

According to other particular embodiments of the present invention, the moveable multi-position sensor 14 may be rotatable about at least two or at least three axes. Rotation of the moveable multi-axis position sensor 14 about multiple axes allows the music control device to control up to two or three music effects or characteristics. By way of example and not limitation, the rotation of the moveable sensor 14 about the X-axis 40 or roll may control volume of the instrument, rotation about the Y-axis 42 or pitch may control the vibrato of the instrument and rotation about the Z-axis 44 or yaw may control the tone of the instrument. It will be understood that these music effects 18 are not a limitation but merely an example of the types of music effects 18 or characteristics that may be controlled by the music control device 10. Other music effects may be controlled, such as, but not limited to wah, distortion, pitch and the like.

Another embodiment of the present invention may further include a database 22 storing various curves correlating to a desired music effect. This allows the music control device 10 to measure the difference in the angle between a reference and moveable multi-axis position sensors 12 and 14 and then depending on the measured angle differentiation, the music control device 10 looks up a particular curve representing a change, rate of change or other music expression that generates or manipulates a music effect from the database 22 and applies the stored curve to the music effect 18 of the electric instrument. It will be understood that the processor 16 may be adapted to compare the measured angle differentiation with the database 22. Multiple look-up tables may be stored on a particular database 22, each look-up table corresponding to a particular axis of rotation of the moveable multi-axis sensor 14, thereby controlling a particular music effect 18. Additionally, the music control device 10 may allow a musician in real time to select a particular desired effect and curve for the effect from the multiple look-up tables and associate the selected effect and effect curve with a particular axis of a multi-axis sensor 14. This allows the musician to assign a particular effect 18 to a particular axis as well as assigning a particular effect curve with the axis. The look-up tables may be customizable by a musician, wherein the musician may store particular preferred curves that are accessed from the look-up table during operation of the music control device 10.

Figure 6:
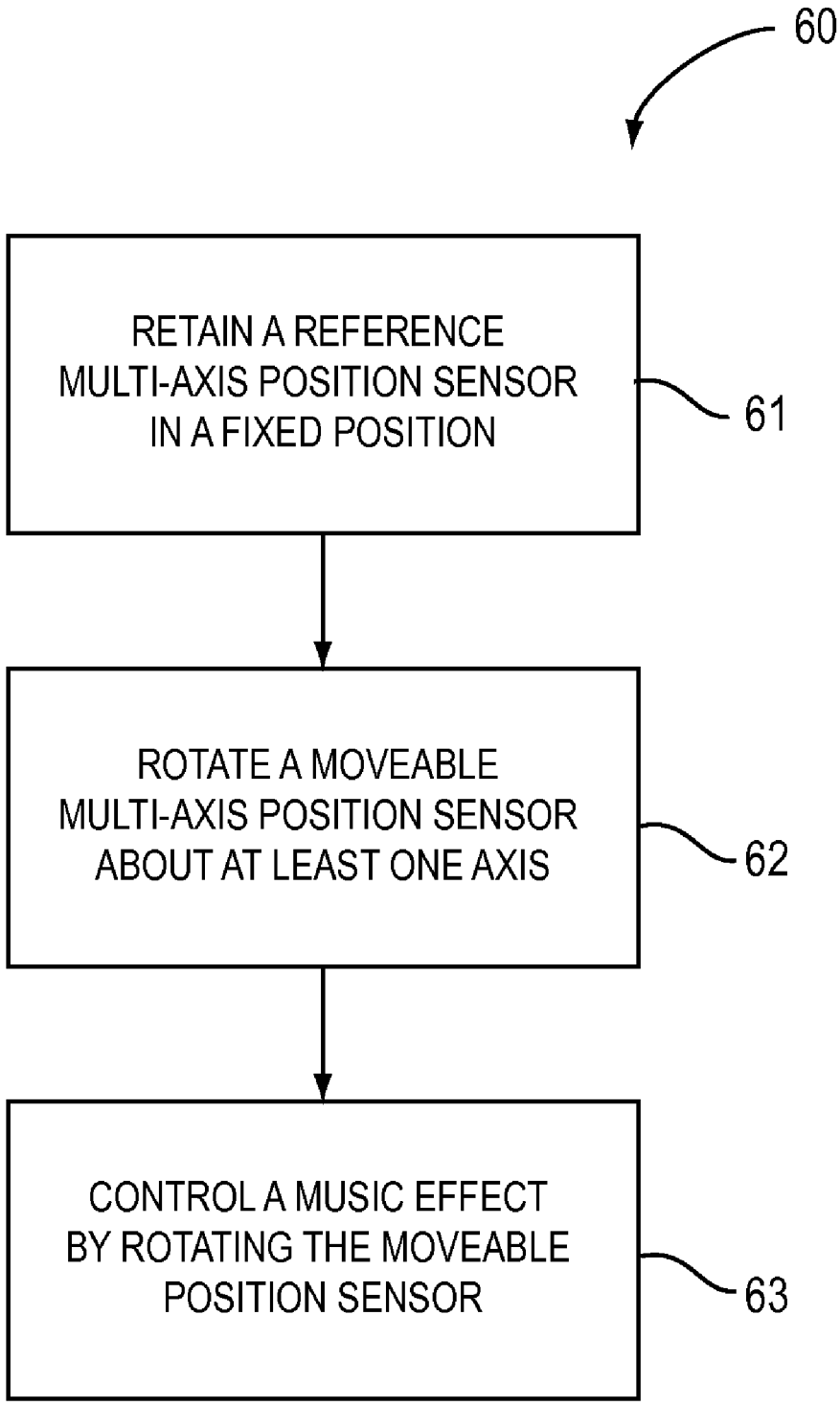
FIG. 6 is a flow chart of a method of using a music control device in accordance with the present invention.

Referring to FIG. 6, another embodiment of the present invention may include a method 60 of using an electric instrument music control device. The method 60 may comprise retaining a reference multi-axis position sensor in a fixed position (Step 61), rotating a moveable multi-axis position sensor about at least one axis (Step 62), and controlling a music effect by rotating the moveable position sensor (Step 63). Step 63 of controlling the music effect may include the steps of measuring the angle of the moveable multi-axis position sensor about the at least one axis, calculating the difference between the angle of the moveable multi-axis position sensor and the reference multi-axis position sensor and changing the music effect according the differentiation of the angles. The method 60 may further include controlling two or more music effects employing the same steps, wherein each axis of rotation corresponds to a different music effect.

Figure 4:
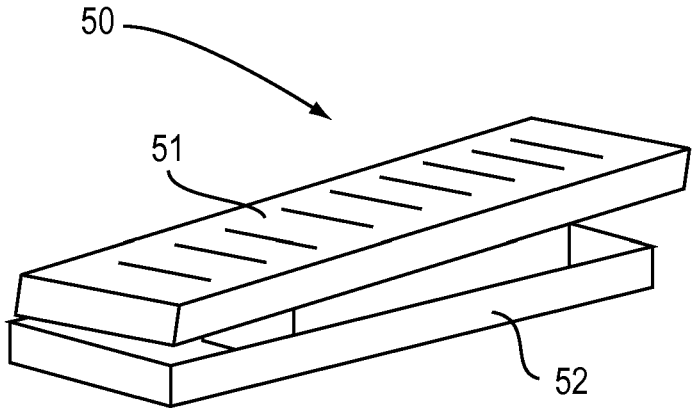
FIG. 4 is a perspective view of a foot pedal having a moveable multi-axis position sensor.

Referring to FIG. 4, the electric instrument music control device may be employed as a foot pedal 50, wherein the foot pedal 50 has a pedal portion 51 as the input device and may be rotatable about at least three axis. The foot pedal 50 may include a base portion 52 and a pedal portion 51. The base portion 52 may support the pedal portion 51 and a rotation mechanism that allows the pedal portion 51 to be rotated about at least one axis by applying force on the pedal portion 51 corresponding to rotation about each axis. The base portion 52 may further retain the reference multi-axis position sensor 12 (FIG. 1) in a fixed position. The pedal portion 51 may retain the moveable multi-axis position sensor 14 (FIG. 1). As the pedal portion 51 is rotated about an axis the moveable sensor 14 is also rotated about the axis. The reference and moveable sensors 12 and 14 may be in communication with each other and the base portion 52 may further retain a processor 16 that calculates the difference between the angle of the moveable sensor 14 and the angle of the reference sensor 12 with respect to the axis of rotation. The difference in the angles produces a desired change in a music characteristic 18. The reference and moveable sensors 12 and 14 may communicate through wire connection. In particular embodiments, wireless communication between the reference and moveable sensors 12 and 14 may be employed, such as a Bluetooth™ communication, infra red or other wireless communication.

Figure 5A:
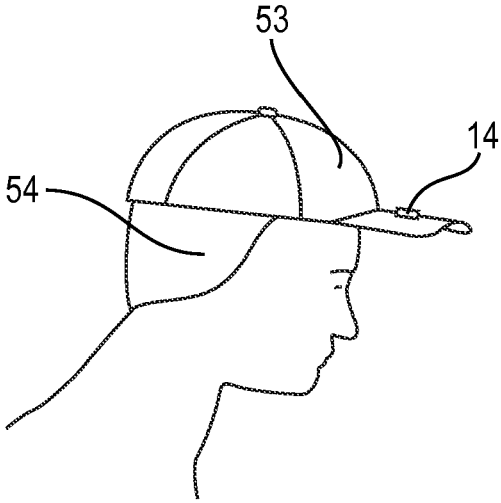
FIG. 5A is perspective view of a person having a moveable multi-axis position sensor coupled to the head of the person.
Figure 5B:
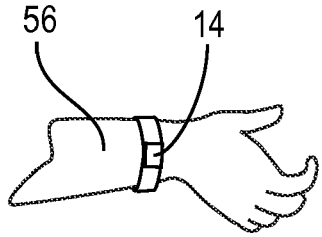
FIG. 5 B is a perspective view of a moveable multi-axis position sensor couple to an arm of a person.

Referring further to the drawings, FIGS. 5*a* and 5B depict other particular embodiments of the present invention may be employed in other ways, such as having a base unit that retains the reference multi-position sensor and the processor, and an input device having a moveable multi-axis position sensor 14 attachable to a moveable part of the musician, such as the musician's head 54, wherein the moveable sensor 14 may be attached to a hat 53 on the musician's head 54; an arm 56 or other appendage. The input device may include the moveable multi-axis position sensor 14 and the musician may use his or her appendage to rotate the moveable sensor 14 about the axes of rotation to control various music effects. In other embodiments, an input device with a moveable multi-axis position sensor 14 may be placed upon any moveable object, such as, but not limited to, an electric instrument, and instrument strap, and the like.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. An electric instrument music control device comprising:

a reference multi-axis position sensor retained in a fixed position, wherein the reference multi-axis position sensor has at least one axis held in a fixed position;

a moveable multi-axis position sensor rotatable about at least one axis corresponding to the at least one axis of the reference multi-axis position sensor, wherein the moveable multi-axis position sensor is in communication with the reference multi-axis position sensor;

a processor that processes the differentiation between the angular position of the at least one axis of the reference multi-axis position sensor and the at least one axis of the moveable multi-axis position sensor, wherein the angular differentiation correlates to a music effect of an electric instrument; and a wireless connection between the reference multi-axis position sensor and the moveable multi-axis position sensor, the communication between the sensors occurring through the wireless connection.

2. The device of claim 1, wherein the moveable multi-axis position sensor is rotatable about at least two axes, wherein rotation about each axis correlates to a different music effect.

3. The device of claim 1, wherein the moveable multi-axis position sensor is rotatable about at least three axes, wherein rotation about each axis correlates to a different music effect.

4. The device of claim 1, wherein the moveable multi-axis position sensor is removably coupled to a moveable appendage of a musician.

5. The device of claim 4, further comprising a dynamic distance between the reference multi-axis position sensor and the moveable multi-axis position sensor, wherein the dynamic distance changes in response to movement of the musician toward and away from the reference multi-axis position sensor.

6. The device of claim 1, further comprising a database, wherein the database stores various curves correlating to a desired music effect in a look-up table.

7. The device of claim 6, wherein the processor is adapted to compare the angular differentiation with the various curves stored in the database and applies the music effect corresponding to the angular differentiation.

8. An electric instrument music control device comprising:

a reference multi-axis position sensor retained in a fixed position, wherein the reference multi-axis position sensor has at least one axis held in a fixed position;

a moveable multi-axis position sensor rotatable about at least one axis corresponding to the at least one axis of the reference multi-axis position sensor, wherein the moveable multi-axis position sensor is in communication with the reference multi-axis position sensor and is removably coupled to a moveable appendage of a musician;

a processor that processes the differentiation between the angular position of the at least one axis of the reference multi-axis position sensor and the at least one axis of the moveable multi-axis position sensor, wherein the angular differentiation correlates to a music effect of an electric instrument; and a dynamic distance between the reference multi-axis position sensor and the moveable multi-axis position sensor, wherein the dynamic distance changes in response to movement of the musician toward and away from the reference multi-axis position sensor.

9. The device of claim 8, wherein the moveable multi-axis position sensor is rotatable about at least two axes, wherein rotation about each axis correlates to a different music effect.

10. The device of claim 8, wherein the moveable multi-axis position sensor is rotatable about at least three axes, wherein rotation about each axis correlates to a different music effect.

11. The device of claim 8, further comprising a wired connection coupled between the reference multi-axis position sensor and the moveable multi-axis position sensor, the communication between the sensors occurring through the wired connection.

12. The device of claim 8, further comprising a wireless connection between the reference multi-axis position sensor and the moveable multi-axis position sensor, the communication between the sensors occurring through the wireless connection.

13. The device of claim 8, further comprising a database, wherein the database stores various curves correlating to a desired music effect in a look-up table.

14. The device of claim 13, wherein the processor is adapted to compare the angular differentiation with the various curves stored in the database and applies the music effect corresponding to the angular differentiation.

* * * * *